US005450647A

United States Patent [19]

Dorsey

[11] Patent Number: 5,450,647

[45] Date of Patent: Sep. 19, 1995

[54] BACK WASHING AND SCRUBBING APPARATUS

[76] Inventor: Steven C. Dorsey, 6620 Ridgetree La. #616, Arlington, Tex. 76017

[21] Appl. No.: 260,246

[22] Filed: Jun. 14, 1994

[51] Int. Cl.[6] ..... A47K 7/04

[52] U.S. Cl. ..... 15/97.1; 15/21.1; 4/606

[58] Field of Search ..... 15/97.1, 21.1, 88.4; 4/606

[56] References Cited

U.S. PATENT DOCUMENTS 3,085,269 4/1963 Greer ..... 15/21.1
4,151,623 5/1979 Steere ..... 15/21.1

*Primary Examiner*—Edward L. Roberts, Jr.

[57] ABSTRACT

A back washing and scrubbing apparatus comprising a gearbox having an inlet and an outlet with the inlet adapted to be coupled to a water line; a nozzle having an base end and a tip end with the tip end coupled to the outlet; a gear mechanism disposed in the gearbox and coupled to the tip end of the nozzle with the gear mechanism adapted to rotate due to water flow from the inlet to the outlet, thus enabling rotation of the nozzle; a rotating pulsating mechanism disposed within the nozzle for intermittently allowing passage of flowing water from the base end thereof; a perforated surface coupled to the base end of the nozzle to define a shower head for delivering rotating and pulsating streams of water therefrom; and an agitation actuator mechanism adapted to be engagably coupled with the gear mechanism by a bather for intermittently interrupting its rotation, thus enabling agitated rotation of the shower head.

7 Claims, 4 Drawing Sheets

BACK WASHING AND SCRUBBING APPARATUS

BACKGROUND OF THE INVENTION

1. Field of the Invention

The present invention relates to a back washing and scrubbing apparatus and more particularly pertains to washing and scrubbing a person's back with a back washing and scrubbing apparatus.

2. Description of the Prior Art

The use of washing and scrubbing apparatuses is known in the prior art. More specifically, washing and scrubbing apparatuses heretofore devised and utilized for the purpose of washing and scrubbing a person are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 298,291 to Lanier discloses a combined wall-mounted water-powered shower brush and accessory shelf unit. U.S. Pat. No. 3,875,604 to Wurn et al. discloses a shower back scrubber. U.S. Pat. No. 4,696,068 to Kenner discloses a shower wall and bathtub mounted back washer. U.S. Pat. No. 5,065,463 to Le discloses the structure of a shower with swivel brush and multi-step drain control. U.S. Pat. No. 5,105,484 to Forsythe discloses a back scrubber device.

While these devices fulfill their respective, particular objective and requirements, the aforementioned patents do not describe a back washing and scrubbing apparatus that allows a bather to simultaneously have his back cleaned and massaged.

In this respect, the back washing and scrubbing apparatus according to the present invention substantially departs from the conventional concepts and designs of the prior art, and in doing so provides an apparatus primarily developed for the purpose of washing and scrubbing a person's back.

Therefore, it can be appreciated that there exists a continuing need for new and improved back washing and scrubbing apparatus which can be used for washing and scrubbing a person's back. In this regard, the present invention substantially fulfills this need.

SUMMARY OF THE INVENTION

In the view of the foregoing disadvantages inherent in the known types of washing and scrubbing apparatuses now present in the prior art, the present invention provides an improved back washing and scrubbing apparatus. As such, the general purpose of the present invention, which will be described subsequently in greater detail, is to provide a new and improved back washing and scrubbing apparatus and method which has all the advantages of the prior art and none of the disadvantages.

To attain this, the present invention essentially comprises, in combination, a gearbox having a generally tubular outer casing with a hollow interior therein. A tubular and rigid inlet pipe is included and has a first end adapted to be coupled to a water line and a second end extended through the casing and within the interior of the gearbox. A rigid and generally funnel-shaped nozzle is included and has a central axis, a radially extended base end, and a tapered tip end. A tubular rigid outlet pipe is included and has a first end coupled to the tip end of the nozzle and a perforated second end rotatably disposed through the casing and within the interior of the gearbox. A tubular and rigid actuating gear is included and disposed within the interior of the gearbox, coupled to the second end of the outlet pipe, and rotatably coupled to the second end of the inlet pipe with the actuating gear further having a central axis, a plurality of spaced indentations peripherally formed thereon in a circumferential fashion and a plurality of spiral apertures formed therethrough with each aperture having an entrance facing the second end of the inlet pipe and an exit facing outwards from the periphery thereof, whereby when water from the inlet pipe flows through the apertures, the actuating gear rotates about its central axis, thus enabling rotation of the nozzle about its central axis. A pulsating disc is included and disposed within the nozzle near the base end thereof with the pulsating disc having a plurality of outwardly extended and radial edges coupled thereto with the edges in combination with the disc defining a plurality of compartments adapted for containing water flow from the tip end of the nozzle. The pulsating disc further includes a plurality of pairs of holes with each pair of holes disposed thereon between alternate pairs of edges for allowing water to flow from the compartments. An actuating rod is included and has a central axis, a first end, a second end, and a plurality of vanes extended outwards therefrom with the first end coupled to the centroid of the pulsating disc and the second end rotatably coupled to the tip end of the nozzle in a manner adapted for allowing water to flow therearound, whereby when water flows across the vanes thereof, the pulsating disc rotates about the central axis of the actuating rod. A perforated containment disc is included and coupled over the base end of the nozzle to define a shower head with the shower head adapted for delivering pulsating and rotating streams of water therefrom when water flows through the rotating pulsating disc. An agitation actuator is included and has a tubular sleeve with a first end coupled to the gearbox and a second end adapted to be secured to a wall, a flexible rod disposed within the sleeve with the rod having a tip end extended within the interior of the gearbox and positioned near the indentations of the actuating gear and a base end extended from the second end of the sleeve with a depressable button formed thereon, whereby when the button is depressed, the tip end is temporarily engaged in the indentations of the actuating gear, thus intermittently interrupting its rotation, thus enabling the agitated rotation of the shower head. Lastly, a cloth cap is included and disposed over the shower head and adapted to be positioned against a bather's back for transferring rotating streams of water and agitated rotational motion from the shower head thereto, thus allowing a bather's back to be simultaneously cleaned and massaged.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved back washing and scrubbing apparatus which has all the advantages of the prior art washing and scrubbing apparatuses and none of the disadvantages.

It is another object of the present invention to provide a new and improved back washing and scrubbing apparatus which may be easily and efficiently manufactured and marketed.

It is a further object of the present invention to provide a new and improved back washing and scrubbing apparatus which is of durable and reliable construction.

An even further object of the present invention is to provide a new and improved back washing and scrubbing apparatus which is susceptible of a low cost of manufacture with regard to both materials and labor, and which accordingly is then susceptible of low prices of sale to the consuming public, thereby making such a back washing and scrubbing apparatus economically available to the buying public.

Still yet another object of the present invention is to provide a new and improved back washing and scrubbing apparatus which provides in the apparatuses and methods of the prior art some of the advantages thereof, while simultaneously overcoming some of the disadvantages normally associated therewith.

Even still another object of the present invention is to provide a new and improved back washing and scrubbing apparatus for washing and scrubbing a person's back.

Lastly, it is an object of the present invention to provide a new and improved back washing and scrubbing apparatus comprising a gearbox having an inlet and an outlet with the inlet adapted to be coupled to a water line; a nozzle having an base end and a tip end with the tip end coupled to the outlet; gear means disposed in the gearbox and coupled to the tip end of the nozzle with the gear means adapted to rotate due to water flow from the inlet to the outlet, thus enabling rotation of the nozzle; rotating pulsating means disposed within the nozzle for intermittently allowing passage of flowing water from the base end thereof; a perforated surface coupled to the base end of the nozzle to define a shower head for delivering rotating and pulsating streams of water therefrom; and agitation actuator means adapted to be engagably coupled with the gear means by a bather for intermittently interrupting its rotation, thus enabling agitated rotation of the shower head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
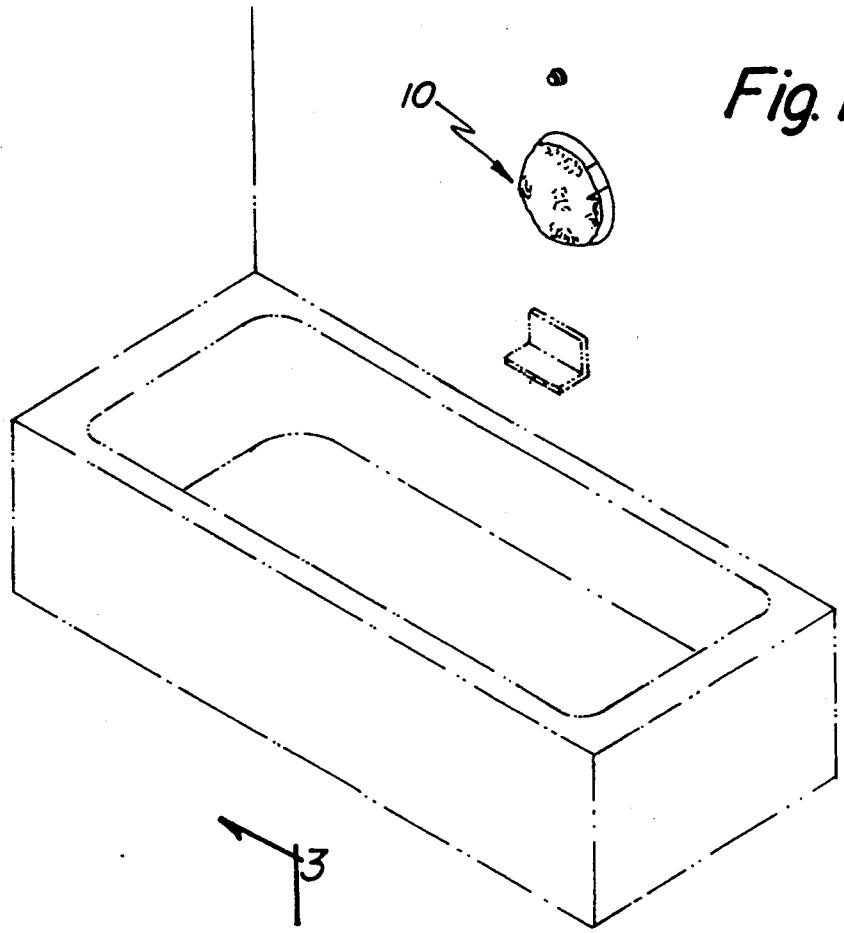
FIG. 1 is a perspective view of the preferred embodiment constructed in accordance with the principles of the present invention positioned at a location for scrubbing a person's back in a bathtub.
Figure 2:
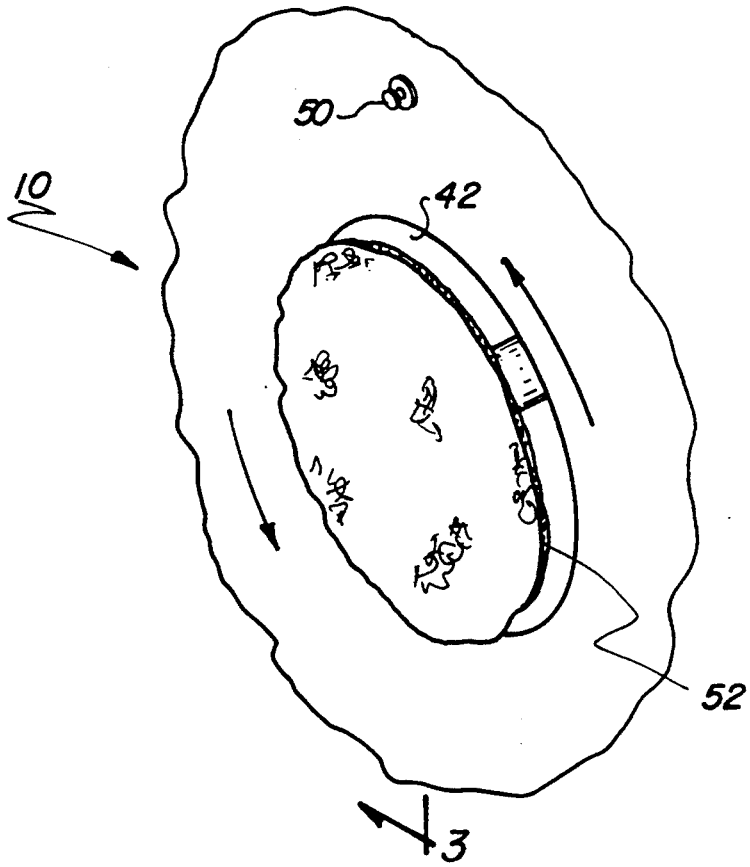
FIG. 2 is an enlarged perspective view of the present invention depicting its intended rotational and agitating movements.
Figure 3:
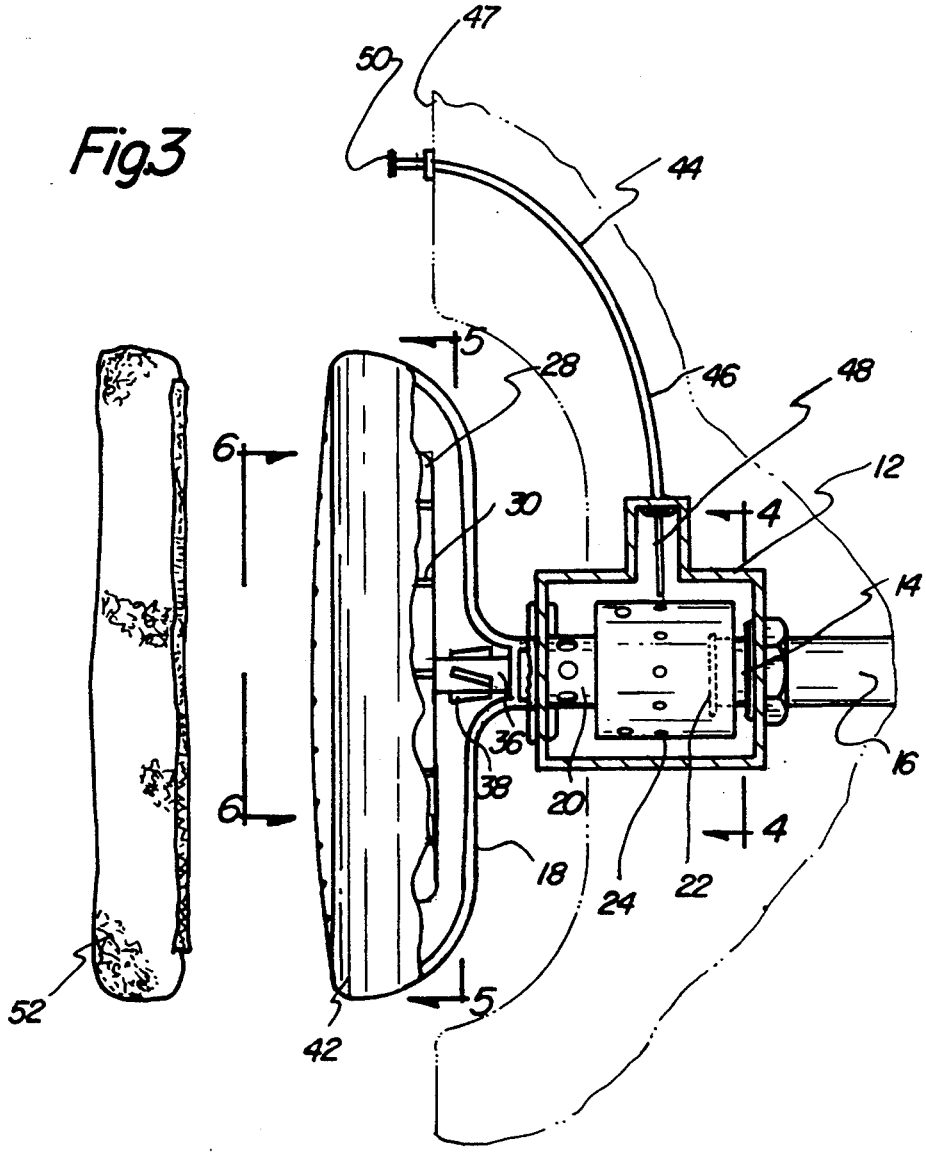
FIG. 3 is an exploded cross-sectional view of the present invention depicting its major components.
Figure 4:
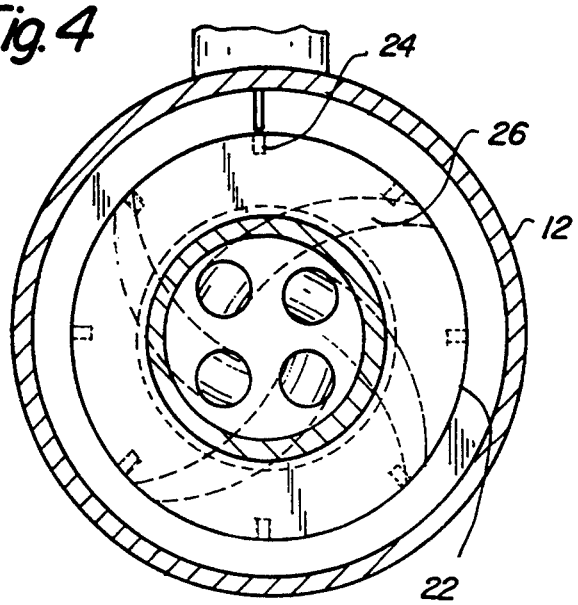
FIG. 4 is a cross-sectional view of the gearbox and actuator taken along the line 4—4 of FIG. 3.
Figure 5:
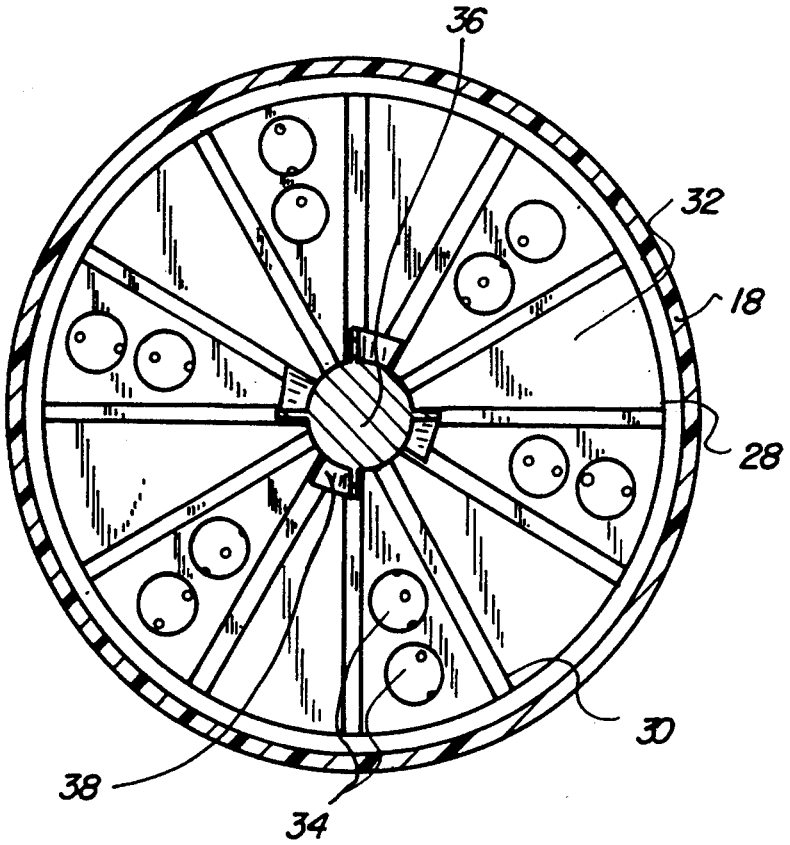
FIG. 5 is a cross-sectional view of the present invention taken along the line 5—5 of FIG. 3.
Figure 6:
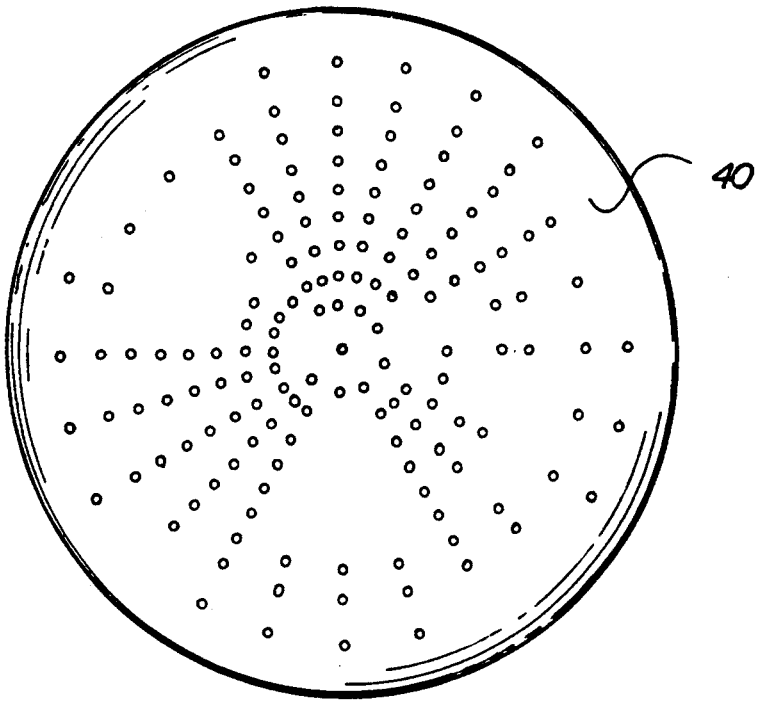
FIG. 6 is a view of the shower head taken along the line 6—6 of FIG. 3.

With reference now to the drawings, and in particular, to FIGS. 1 through 6 thereof, the preferred embodiment of the new and improved back washing and scrubbing apparatus embodying the principles and concepts of the present invention and generally designated by the reference number 10 will be described.

Specifically, the present invention includes 10 major components. The major components are the gearbox, inlet pipe, nozzle, outlet pipe, actuating gear, pulsating disc, actuating rod, containment disc, agitation actuator, and cap. These components are interrelated to provide the intended function.

More specifically, it will be noted in the various Figures that the first major component is the gearbox 12. The gearbox is rigid and generally tubular in structure. It has an outer casing with a hollow interior therein. The gearbox is adapted to be positionable in and coupleable within a wall.

The second major component is the inlet pipe 14. The inlet pipe is tubular and rigid in structure. It has a first end adapted to be coupled to a water line 16. This coupling is performed with a threaded bolt. The inlet pipe also has a second end extended through the casing and within the interior of the gearbox 12. The inlet pipe delivers water from the water line to the interior of the gearbox.

The third major component is the nozzle 18. The nozzle is rigid and generally funnel-shaped in structure. The nozzle has a central axis therethrough. It also has a radially extended base end and a tapered tip end. The base end is positioned such that it extends outwards from the surface of a wall.

The fourth major component is the outlet pipe 20. The outlet pipe is tubular and rigid in structure. It has a first end coupled to the tip end of the nozzle 18. It also has a perforated second end. The second end is rotatably disposed through the casing and within the interior of the gearbox 12. The outlet pipe is adapted to transfer water from the interior of the gearbox. This transfer is performed through the perforations thereof that are positioned within the interior of the gearbox.

The fifth major component is the actuating gear 22. The actuating gear is tubular and rigid in structure. It is disposed within the interior of the gearbox. The actuating gear is coupled to the second end of the outlet pipe 20 and rotatably coupled to the second end of the inlet pipe 14. In this configuration, the central axis of the actuating gear is aligned with the central axes of both the inlet pipe and outlet pipe. The actuating gear also includes a plurality of spaced indentations 24 peripherally formed thereon in a circumferential fashion. The actuating gear also includes a plurality of spiral apertures 26 formed therethrough. Each aperture has an entrance facing the second end of the inlet pipe 14 and an exit facing outwards from the periphery thereof. Water flows from the inlet pipe through these apertures. The force of the water upon the actuating gear due to the spiral structure of the apertures causes it to rotate about its central axis. Rotation of the actuating gear thereby causes rotation of the nozzle about its central axis.

The sixth major component is the pulsating disc 28. The pulsating disc is disposed within the nozzle 18 near the base end thereof. The pulsating disc is positioned perpendicular to the central axis of the nozzle. The pulsating disc has a plurality of outwardly extended and radial edges 30 coupled thereto. These edges are positioned facing the tip end of the nozzle. The edges in combination with the surface of the disc define a plurality of compartments 32 adapted for containing water flow directed from the tip end of the nozzle. These compartments also help to create a back pressure within the nozzle. The pulsating disc further includes a plurality of pairs of holes 34. Each pair of holes is disposed thereon between alternate pairs of edges. The holes allow pressurized water to flow from the compartments.

The seventh major component is the actuating rod 36. The actuating rod is rigid in structure. It has a central axis. The actuating rod has a first end, a second end, and a plurality of vanes 38 extended outwards therefrom and therealong in a curved fashion. The first end is coupled to the centroid of the pulsating disc 28. The second end is rotatably coupled to the tip end of the nozzle 18 in such a manner adapted for allowing water to flow therearound. When water from the outlet pipe flows across the vanes, the rod rotates about its central axis, thus rotating the pulsating disc.

The eighth major component is the containment disc 40. The containment disc is rigid and perforated in structure. It is coupled over the base end of the nozzle 18 to define a shower head 42. The containment disc is also positioned near the pulsating disc. The perforations in the containment disc are smaller than the holes in the pulsating disc. Thus, the containment disc also assists in the development of the back pressure generated in the compartments of the pulsating disc. The containment disc also allows water to be forced in streams from each compartment 32 through the perforations thereof. Thus, the shower head is adapted for delivering pulsating and rotating streams of water due to its association with the pulsating disc, actuating rod, and nozzle.

The ninth major component is the agitation actuator 44. The agitation actuator has a tubular sleeve 46. The first end of the sleeve is coupled to the gearbox 12. The second end of the sleeve is adapted to be secured to a wall 47. The agitation actuator includes a flexible rod 48 disposed within the sleeve. The rod has a tip end extended within the interior of the gearbox. The tip end is positioned near the indentations 24 of the actuating gear. The base end of the nod is extended from the second end of the sleeve. It has a depressible button 50 formed thereon. When the button is depressed, the tip end is temporarily engaged in the indentations of the actuating gear. This engagement intermittently stopping interrupts the rotation of the actuation gear, thus disenabling agitated rotation of the shower head 42. The amount of time that the tip end of the rod is engaged in one or more of the indentations of the actuating gear is based on strength of depressive pressure applied to the button by a bather as well as the pressure of the water flow. When a heavy depressive force is placed upon the button 50 by a bather, the tip end of the rod is substantially engaged within one of the indentations and interrupts rotation of the actuating gear, thereby stopping rotation of the shower head. When a light depressive force is placed upon the button by a bather, the tip end of the rod is just barely engaged within one of the indentions. Due to the flexible nature of the rod in conjunction with the pressure of water flow, the tip end is dislodged from the indentation to subsequently become temporarily engaged within and then dislodged from succeeding indentations, thereby slowing the rotation of the shower head. If the button is fully released by a bather, the actuating gear rotates at a speed dependent upon the water pressure applied. Now, if a bather somewhat randomly applies differing depressive forces upon the button or no depressive forces at all, agitated rotation of the shower head is realized.

The tenth major component is the cap 52. The cap is formed of a cloth material such as cotton. It is disposed over the shower head 42 and adapted to be positioned against a bather's back for transferring rotating streams of water and agitated rotational motion from the shower head thereto. Thus, the cloth cap allows a bather to clean and massage his or her back. The cloth cap is adapted to be de-coupled from the shower head for cleaning or replacement.

Figure 7:
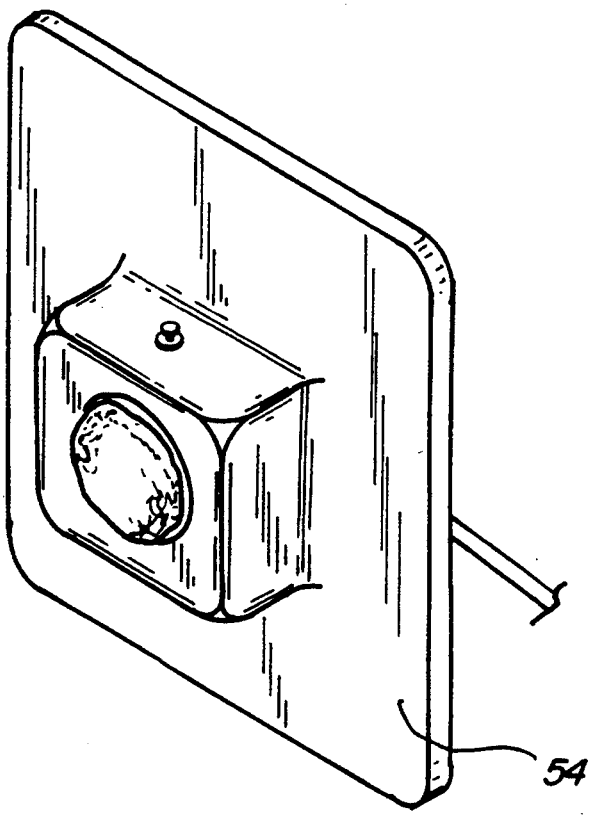
FIG. 7 is a perspective view an alternate embodiment of the present invention secured to a positionable mounting bracket.
Figure 8:
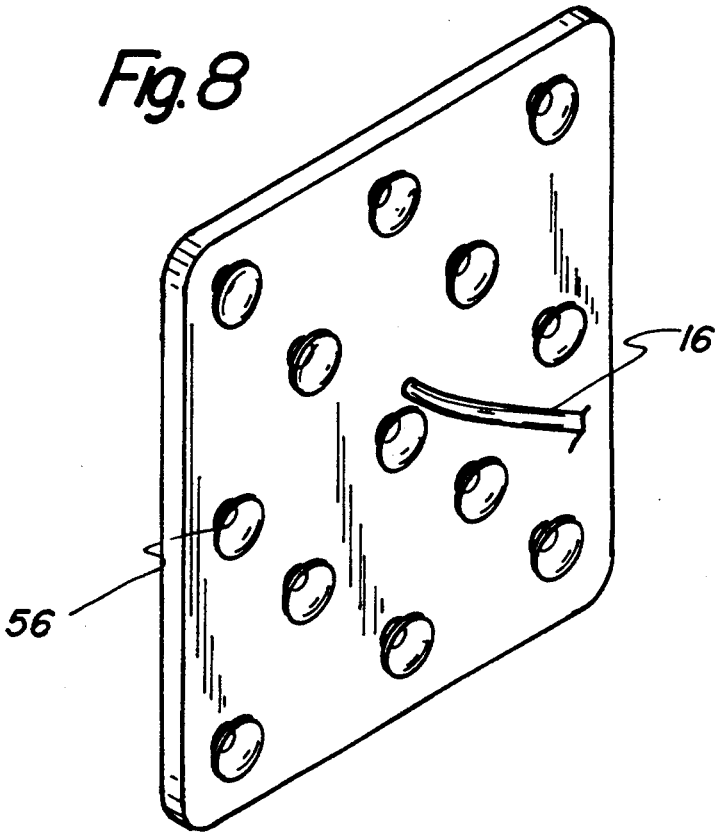
FIG. 8 is a rear perspective view of the alternate embodiment depicting a plurality suction cups used to couple the mounting bracket thereof to a location for use.

A second embodiment of the present invention is shown in FIGS. 7–8 and includes substantially all of the components of the present invention further including a portable containment vessel 54. The portable containment vessel is rigid in structure. It is formed of a rigid material such as plastic. The containment vessel is adapted for holding the gearbox, pulsating means, shower head, and agitation actuator in a fixed relationship for use. The containment vessel further includes a plurality of suction cups 56 coupled thereto. The suction cups are adapted for securing the containment vessel to an external fixed object such as a wall. In this configuration, the scrubbing apparatus may be positioned at a desired location for use or removed for transport to another location.

In the preferred embodiment, the perforated disc of the shower head is sized with a diameter between about 10" and 12". The inlet pipe is adapted to be connected to a ½" water pipe of a water system. The actuating gear of the present invention allows the shower head to either be intermittently rotated or rotated at a very low speed. The shower head is adapted to be positioned at a location about 24" to about 30" above the floor of a shower or tub. The nozzle of the shower head is formed with a plastic material. The cloth sleeve of the present invention is adapted to be removable for washing. The rotational motion of the cloth when placed upon a bather's back creates a massaging motion.

The present invention is a device for washing and scrubbing one's back. It is intended to be used in a bathroom shower and can be installed permanently in a shower wall at the manufacturer's or bought separately and installed in an existing shower wall. A lot of people have difficulty in washing their backs thoroughly, especially the elderly, people with arthritis, and handicapped people.

At its front the present invention has a 10–12 inch diameter plastic disc shaped like a shower head with numerous small holes in its surface. A removable, washable, shaggy cloth sleeve covers the disc. A ½ inch diameter water inlet pipe extends from the back of the disc to a water connection. A gear box, agitator, or pressure regulator located just behind the disc is installed in line with the inlet pipe. It rotates the disc slowly or agitates it back and forth, either by water pressure or a combination of water pressure and the regulator. A button mounted on the shower wall with flexible rod or wire running to the gear box or agitator activates the motion. The present invention is installed permanently into the shower wall. A portable unit would have a base with suction cups to secure it to the shower wall and a flex hose that would connect to the shower head.

To use the present invention, the bather pushes the button to agitate the showed head and places his or her back up against the cloth cover. The shower head starts rotating or agitating back and forth while water coming through the outlet pipe soaks the cloth, enabling it to wash the bather's back. Soap can be added to the cloth during the back washing routine. The present invention does a thorough job of scrubbing and washing a person's back. It is designed to appeal to people who have difficulty in washing their backs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A back washing and scrubbing apparatus for washing and scrubbing a person's back comprising, in combination:

a gearbox having a generally tubular bored outer casing with a hollow interior therein;

a tubular rigid inlet pipe having a first end adapted to be coupled to a water line for receiving a flow of water therefrom and a second end extended through the casing and within the interior of the gearbox;

a rigid and generally funnel shaped nozzle having a central axis, a radially extended base end, and a tapered tip end;

a tubular rigid outlet pipe having a first end coupled to the tip end of the nozzle and a perforated second end rotatably disposed within the interior of the gearbox so as to provide for discharge of water flow there from;

a tubular and rigid actuating gear disposed within the interior of the gearbox, coupled to the second end of the outlet pipe, and rotatably coupled to the second end of the inlet pipe, the actuating gear further having a central axis, a plurality of spaced indentations peripherally formed thereon in a circumferential fashion and a plurality of spiral apertures formed therethrough with each aperture having an entrance facing the second end of the inlet pipe and an exit facing outwards from the periphery thereof, whereby when water from the inlet pipe flows through the apertures, the actuating gear rotates about its central axis, thus enabling rotation of the nozzle about its central axis;

a pulsating disc disposed within and rotatably coupled to the nozzle near the base end thereof, the pulsating disc having a plurality of outwardly extended and radial edges coupled thereto with the edges in combination with the disc defining a plurality of compartments adapted for containing water flow from the tip end of the nozzle, the pulsating disc further including a plurality of pairs of holes with each pair of holes disposed thereon between alternate pairs of edges for allowing water to flow from the compartments;

an actuating rod having a central axis, a first end, a second end, and a plurality of vanes extended outwards therefrom with the first end coupled to the centroid of the pulsating disc and the second end rotatably coupled to the tip end of the nozzle in a manner adapted for allowing water to flow across the vanes and rotate the pulsating disc about the central axis of the actuating rod;

a perforated containment disc coupled over the base end of the nozzle to define a shower head with the shower head adapted for delivering pulsating and rotating streams of water therefrom when water flows through the rotating pulsating disc;

an agitation actuator having a tubular sleeve with a first end coupled to the gearbox and a second end adapted to be secured to a wall, a flexible rod disposed within the sleeve with the rod having a tip end extended within the interior of the gearbox and positioned near the indentations of the actuating gear and a base end extended from the second end of the sleeve with a depressible button formed thereon, whereby when the button is intermittently depressed, the tip end of the rod is temporarily engaged in the indentations of the actuating gear based on depressive pressure applied to the button and pressure of the water flow, thus intermittently interrupting or slowing rotation of the actuating gear, thereby enabling agitated rotation of the shower head while providing for continued rotation of the pulsating disc; and a cloth cap disposed over the shower head and adapted to be positioned against a bather's back for transferring rotating streams of water and agitated rotational motion from the shower head thereto, thus allowing a bather's back to be simultaneously cleaned and massaged.

2. A back washing and scrubbing apparatus comprising:

a gearbox having an inlet and an outlet with the inlet adapted to be coupled to a water line;

a nozzle having a base end and a tip end with the tip end rotatably disposed within the outlet;

gear means disposed in the gearbox and coupled to the tip end of the nozzle for rotating the nozzle when actuated by water flow from the inlet to the outlet of the gearbox;

pulsating means disposed within the nozzle for intermittently allowing passage of flowing water from the base end thereof;

a perforated surface coupled to the base end of the nozzle to define a shower head for delivering pulsating and rotating streams of water therefrom; and depressible flexible agitation actuator means engagably coupled with the gear means for intermittently interrupting or slowing rotation of the gear means upon application of intermittent varying depressive pressure applied by a bather, thereby enabling agitated rotation of the shower head.

3. The apparatus as set forth in claim 2 further including a cloth cap disposed over the shower head and adapted to be positioned against a bather's back for transferring water and agitated rotational motion from the shower head, thus allowing a bather's back to be simultaneously cleaned and massaged.

4. The apparatus as set forth in claim 2 wherein the gear means is a gear having a central axis, a plurality of spaced indentations peripherally formed therearound and a plurality of spiral apertures formed therethrough with each aperture having an entrance facing the inlet and an exit facing peripherally outwards therefrom, whereby when water from the inlet flows through each aperture from each entrance to each exit thereof, the actuating gear rotates, thus rotating the nozzle.

5. The apparatus as set forth in claim 2 wherein the pulsating means comprises:

a pulsating disc disposed within the nozzle having a plurality of outwardly extended and radial edges coupled thereto with the edges in combination with the disc defining a plurality of compartments adapted for containing water, the pulsating disc further including a plurality of holes disposed thereon adapted for enabling water to flow from the compartments; and an actuating rod having a first end, a second end, and a plurality of vanes extended outwards therefrom with the first end coupled to the pulsating disc and the second end rotatably coupled to the nozzle in a manner for allowing water to flow across the vanes and rotate the pulsating disc.

6. The apparatus as set forth in claim 2 wherein the agitation actuator means has a tubular sleeve with a first end coupled to the gearbox and a second end adapted to be secured to a wall, a flexible rod disposed within the sleeve with the rod having a tip end extended within the gearbox and positioned near the gear means and a base end extended from the second end of the sleeve with a depressible button formed thereon, whereby when the button is intermittently depressed, the tip end of the rod is temporarily engaged with the gear means based on depressive pressure applied to the button and pressure of the water flow, thus intermittently stopping or slowing rotation of the actuating gear, thereby enabling agitated rotation of the shower head.

7. The apparatus as set forth in claim 2 further including a portable containment vessel for holding the gear box, pulsating means, shower head, and agitation actuator in a fixed relationship for use, the vessel further including a plurality of suction cups coupled thereto adapted for securing the containment vessel to an external fixed object such as a wall.

* * * * *